US005216469A

United States Patent [19]

Yamada

[11] Patent Number: 5,216,469

[45] Date of Patent: Jun. 1, 1993

[54] APPARATUS FOR CONTROLLING TONER DENSITY IN A DEVELOPING DEVICE OF AN ELECTROPHOTOGRAPHIC OR ELECTROSTATIC IMAGE FORMING APPARATUS

[75] Inventor: Takanobu Yamada, Toyokawa, Japan

[73] Assignee: Minolta Camera Kabushiki Kaisha, Osaka, Japan

[21] Appl. No.: 699,734

[22] Filed: May 14, 1991

[30] Foreign Application Priority Data

May 15, 1990 [JP] Japan ..... 2-125822

[51] Int. Cl.[5] ..... G03G 15/08

[52] U.S. Cl. ..... 355/246; 118/653; 118/691; 355/208

[58] Field of Search ..... 355/203, 246, 208; 118/688, 689, 691, 653, 656, 657, 658

[56] References Cited

U.S. PATENT DOCUMENTS

| | | | |
|---|---|---|---|
| 4,550,998 | 11/1985 | Nishikawa | 118/691 X |
| 4,551,002 | 11/1985 | Aoki et al. | 118/691 X |
| 4,582,415 | 4/1986 | Hyodo et al. | 118/689 X |
| 4,804,996 | 2/1989 | Snelling | 118/688 X |
| 4,883,019 | 11/1989 | Menjo et al. | 118/691 |
| 4,901,115 | 2/1990 | Nakamura et al. | 355/246 |
| 5,036,358 | 7/1991 | Yoshida | 355/203 |

FOREIGN PATENT DOCUMENTS 0223765 9/1988 Japan ..... 355/245

*Primary Examiner*—A. T. Grimley
*Assistant Examiner*—T. A. Dang
*Attorney, Agent, or Firm*—Willian Brinks Olds Hofer Gilson & Lione

[57] ABSTRACT

A developing device in an image forming apparatus has a developing sleeve through which a two-component toner material is applied onto a photosensitive surface. The developing device has an optical sensor assembly including a sensor casing opening towards the developing sleeve and closed by a transparent electroconductive windowpane to which one of two bias voltages is selectively applied for depositing or clearing toner on and off from the windowpane. The sensor assembly also includes an infrared light source for radiating infrared rays of light through the windowpane and a light receiving element for providing an output indicative of the density of toner deposited on the windowpane while the windowpane is electrically connected with the bias voltage source. A central processing unit operates in response to the output from the light receiving element to calculate the density of toner contained in the developing material. Any change in density of the toner in the developing material can be compensated for.

10 Claims, 3 Drawing Sheets

APPARATUS FOR CONTROLLING TONER DENSITY IN A DEVELOPING DEVICE OF AN ELECTROPHOTOGRAPHIC OR ELECTROSTATIC IMAGE FORMING APPARATUS

BACKGROUND OF THE INVENTION

1. Field of the Invention

The present invention generally relates to a developing device used in an electrophotographic or electrostatic image forming apparatus and, more particularly, to the developing device of a type utilizing a developing material of two-component type including toner and carrier.

2. Description of the Prior Art

In the prior art developing device operable with the use of the toner material of two-component type including toner and carrier, the toner mixing ratio, i.e., the ratio of mixture of the toner relative to the carrier, which is also referred to as the toner density, is one of important factors in stabilizing developing characteristics to accomplish a reproduction of a high quality image. Accordingly, in order to produce a highly favorable image quality, it is necessary to accurately detect the toner density in the developing material and then to strictly control the amount of supply of toner according to a change in toner density thereby to maintain the toner density in the developing material at a constant value at all times.

As a means for accomplishing a toner density control (ATDC), a magnetic ATDC has generally been employed in which the toner supply control is carried out by detecting the magnetic permeability which varies with a change in relative density of magnetic carrier particles. However, if the fluidity of toner is enhanced as a means for accomplishing a favorable reproduction of a half-toned image with a reversal developing system, the bulk density tends vary as a result of a stirring of the developing material and, therefore, the magnetic ATDC cannot be employed.

Under these circumstances, an optical ATDC is generally employed wherein infrared rays of light of 890 nm in wavelength are radiated from an infrared light emitting diode towards the developing material and the rays of light reflected from the developing material are detected by a photodiode. Where this optical ATDC is employed, the infrared rays of light radiated undergo a total reflection with the toner of cyan, magenta or yellow color and the same is true with the toner of black color provided that the black toner material does not employ carbon, but pigments of cyan, magenta or yellow. However, the infrared rays of light tend to be absorbed by carrier particles. In view of this, the toner density can be detected by detecting the rays of light reflected from the developing material.

More specifically, a difference between an output obtained when a reference light is radiated to the photodiode and an output obtained when the reflected light while the developing material is of a normal density is used as a reference value which is subsequently compared with a difference in output obtained at the time of detection so that, when the difference obtained at the time of detection is lower than the reference value, the toner density can be determined to be low and the toner is therefore supplied.

However, in the prior art optical ATDC, it often occurs that the luminosity of the infrared light emitting diode which serves the light source tends to vary with time and/or that an output from a light receiving element tends to vary with change in temperature. Therefore, unless any correction is made to such variation, the toner density cannot be detected accurately.

In view of the foregoing, according to, for example, the Japanese Laid-open Patent Publication No. 63-177174 published in 1988, there is disclosed the use of a standard reflection density pattern for reflecting, in response to a radiated light, rays of light in an amount appropriate to a predetermined reference value for the density of the developing material, so that a reduction in luminosity of the light source with time can be compensated for.

It is also well known that, while an incandescent lamp is employed for the light source and a sensor windowpane is employed in the form of a dichroic mirror, and by selectively positioning in front of a light receiving element one of a filter capable of passing therethrough infrared rays of light and a filter capable of passing therethrough reference rays of light of a wavelength shorter than that of the infrared light, an output detected as a result of reflection from the developing material can be compensated for by a reference output from the sensor resulting from the reference light.

However, according to the prior art, the sensor requires the standard reflection density pattern or the filters to be incorporated therein together with an operating means therefor, rendering the system as a whole to be complicated and bulky accompanied by an increase in manufacturing cost.

SUMMARY OF THE INVENTION

Accordingly, the present invention has been devised with due consideration paid to the foregoing problems and is intended to provide an improved developing device employing a standard structure and wherein any possible detection error resulting from a change in characteristic of a toner density sensor can be compensated for.

In order to accomplish the foregoing object, the present invention provides a developing device which comprises a radiating means for radiating rays of light onto a developing material, a light sensor for receiving rays of light radiated from the radiating means and subsequently reflected from the developing material, a toner density detecting means for detecting a toner density in the developing material on the basis of an output from the light sensor, a toner depositing means for forcibly depositing toner to a detection window of the light sensor, and a correcting means for correcting a value detected by the toner density detecting means on the basis of an output generated from the light sensor during a condition in which the toner depositing means is operated.

According to the present invention, a reference output including factors such as a change in characteristic of elements can be obtained by the output generated from the sensor while the toner is deposited on the detection window of the sensor and, by correcting the sensor output, resulting from the light reflected from the developing material while the depositing means is switched to establish a condition in which no toner is deposited to the detection window, on the basis of the reference output, the toner density can be detected accurately in which a detection error resulting from, for example, the change in characteristic of the elements is compensated for. Also, since neither the standard reflection density pattern nor the filters, or the liken, need be installed separately, the standard structure may be employed and, therefore, the structure is simple and compact and can be manufactured at a reduced cost.

BRIEF DESCRIPTION OF THE DRAWINGS

This and other objects and features of the present invention will become clear from the following description taken in conjunction with a preferred embodiment thereof with reference to the accompanying drawings, in which.

DETAILED DESCRIPTION OF THE EMBODIMENT

Figure 1:
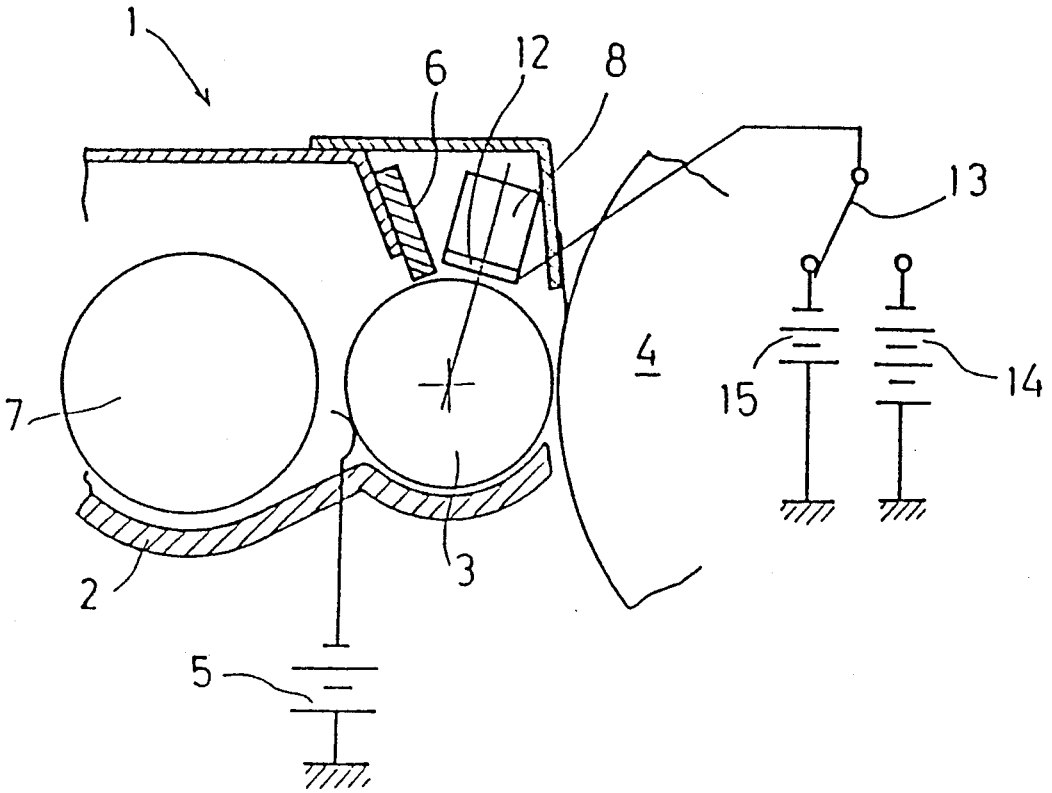
FIG. 1 is a schematic side sectional view of a developing device used in an electrophotographic image forming apparatus according to a preferred embodiment of the present invention.

Referring now to the accompanying drawings, and particularly to FIG. 1, an electrophotographic image forming apparatus with a reversal developing system comprises a developing device generally identified by 1 and comprising a casing 2 in which is accommodated a two-component type developing material consisting of a mass of toner particles adapted to be charged to a negative polarity and a mass of magnetic carrier beads. The developing device 1 also comprises a developing sleeve 3, positioned in the vicinity of a rotatably supported photoreceptor drum 4 with its outer periphery spaced a slight distance from an outer peripheral photosensitive surface of the drum 4, a bias voltage source 5 for applying a developing bias voltage to the developing sleeve 3, a bristle height regulating plate 6 for regulating magnetic bristles on the developing sleeve 3 to a predetermined height, and a stirrer screw 7 rotatably housed within the casing 2 for delivering the developing material onto the developing sleeve 3. A toner density sensor 8, the details of which will subsequently be described with reference to FIG. 2, is housed within the casing 2 and positioned in the vicinity of the developing sleeve 3 and between the bristle regulating plate 6 and the photoreceptor drum 4.

Figure 2:
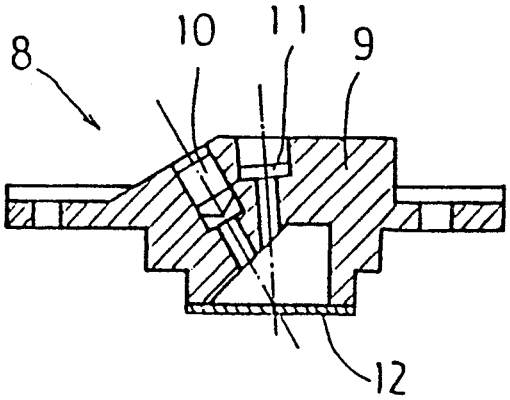
FIG. 2 is a side sectional view, on an enlarged scale, of a density sensor assembly used in the developing device shown in FIG. 1.

With particular reference to FIG. 2, the toner density sensor 8 comprises a sensor casing 9 having a chamber defined therein and opening towards the developing sleeve 3, a sensor windowpane 12 made of a transparent electroconductive material and paned to the sensor casing 9 so as to close the opening of the casing 9, and a photoelectric detector assembly. The photoelectric detector assembly includes an infrared light emitting diode 10 of a type capable of emitting infrared rays of light of 890 nm in wavelength and positioned so as to project the infrared light towards the developing sleeve 3 through the sensor windowpane 12, and a photosensor 11 positioned so as to receive infrared rays of light which have been reflected from the developing sleeve 3.

The sensor windowpane 12 paned to the sensor casing 9 is electrically connected to a selector switch 13 which selectively connects the sensor windowpane 12 to one of first and second bias voltage sources 14 and 15. The first bias voltage source 14 provides a first bias voltage selected to be somewhat lower than the developing bias voltage, applied from the bias voltage source 5 to the developing sleeve 3, and utilized to substantially eliminate or minimize a smearing of the sensor windowpane 12, whereas the second bias voltage 15 provides a second bias voltage selected to be sufficiently higher than the developing bias voltage so that a portion of the toner on the developing sleeve 3 adjacent the toner density sensor 8 can be deposited on the sensor windowpane 12 in at least one layer. By way of example, the developing bias voltage may be −500 volt, the first bias voltage may be −600 volt and the second bias voltage may be −200 volt.

While the toner density sensor 8 is so constructed as hereinbefore described, and when the toner density is to be detected, the selector switch 13 has to be set in position to connect the sensor windowpane 12 with the second bias voltage source 15 so that toner can be electrostatically deposited on the sensor windowpane 12 and an output then generated from the toner density sensor 8 can be detected and stored. This detected output represents a characteristic of the toner density sensor 8 itself. Thereafter, the selector switch 13 is set in position to connect the sensor windowpane 12 with the first bias voltage source 14 to clean the sensor windowpane 12 and, in this condition, an output from the toner density sensor 8 indicative of the infrared rays of light reflected from the developing material on the developing sleeve 3 is detected to provide a detected output which is, together with the stored detected output, utilized to calculate the toner density and compare with a reference density to generate a toner supply signal.

Figure 3:
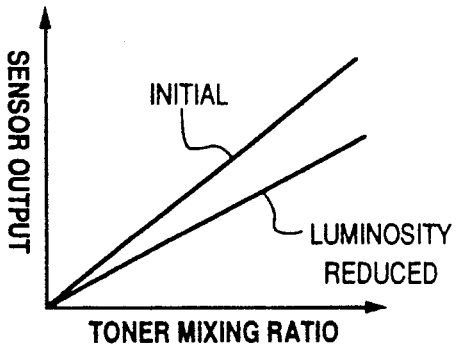
FIG. 3 is a graph showing a relationship between the sensor output and the toner mixing ratio exhibited by an infrared light emitting diode.
Figure 4:
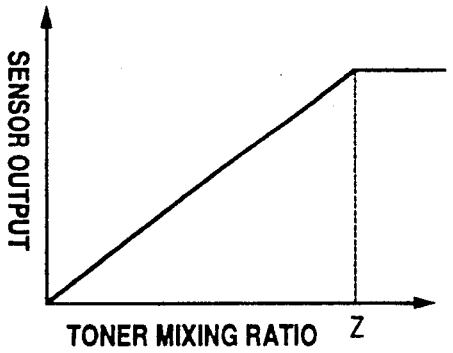
FIG. 4 is a graph showing a change in sensor output with a change in toner mixing ratio.
Figure 5:
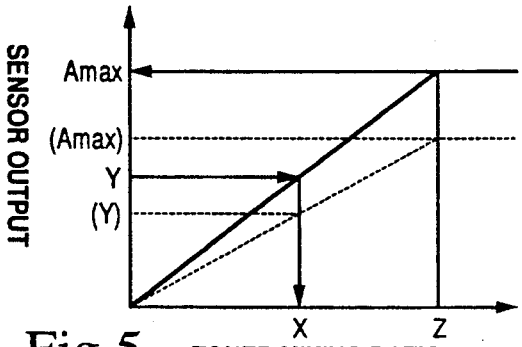
FIG. 5 is a graph used to describe the manner by which the toner mixing ratio is calculated in reference to the sensor output.

The manner by which the toner density is calculated will now be described in detail. A reduction in luminosity of the infrared light emitting diode 10 with time results in a corresponding reduction in the sensor output relative to the toner mixing ratio as shown in FIG. 3. However, as shown by solid and broken lines in the graph of FIG. 4, when the toner mixing ratio is greater than a predetermined value Z in either case, the output from the toner density sensor 8 is similarly saturated. In other words, when the toner mixing ratio is greater than the predetermined value Z, the coverage of the carrier by the toner becomes 100% and, therefore, the sensor output becomes saturated. In view of this, as shown in FIG. 5, assuming that the sensor output (the reference output) provided when the toner mixing ratio is equal to the predetermined value Z at which the output from the toner density sensor 8 is saturated, that is, the output from the toner density sensor 8 provided when the toner is deposited on the sensor windowpane 12, is expressed by Amax, the sensor output provided at the time of detection of the toner density is expressed by Y, and the toner mixing ratio at this time is expressed by X, the following relationship can establish;

$$Z:Amax=X:Y$$

and, accordingly, the toner mixing ratio X can be calculated by the following equation $X=Y.Z/Amax$.

Alternatively, the relationship between the toner mixing ratio and the sensor output provided at the time of detection of the toner density in the developing material relative to the reference output Amax from the toner density sensor 8, that is, the sensor output Amax provided when the toner is deposited on the sensor windowpane 12, may be tabulated in a table so that the toner mixing ratio can be read out from this table.

The details of a toner density control and a method of controlling the toner density using the above discussed table will now be described with reference to FIGS. 6 to 8.

Figure 6:
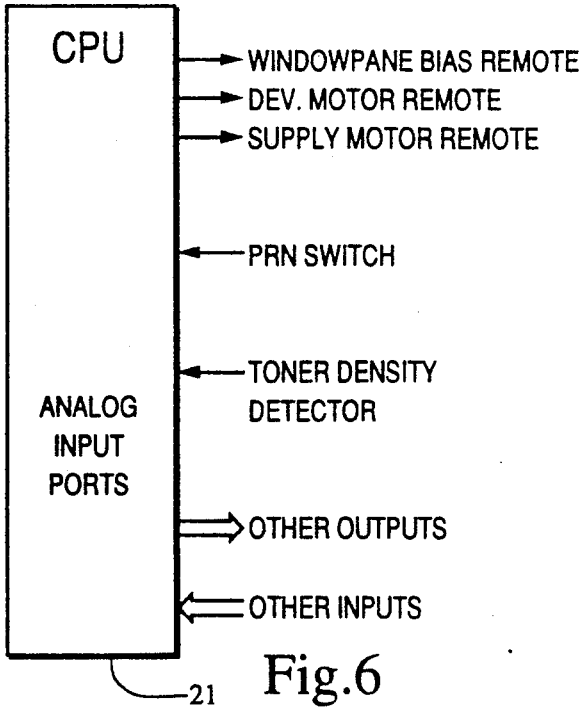
FIG. 6 is a schematic diagram showing a control for the developing device embodying the present invention.

Referring now to FIG. 6, the toner density control comprises a central processing unit 21 for controlling the sequence of entire operation of the image forming apparatus and is adapted to receive various input signals including a PRN (Print) command generated from a PRN switch, the detected signal from the toner density sensor 8 and other input signals and also to output bias signals to the sensor windowpane, a drive signal for driving a developing motor, a remote signal to a supply motor and other output signals necessary for an image forming operation.

Figure 7:
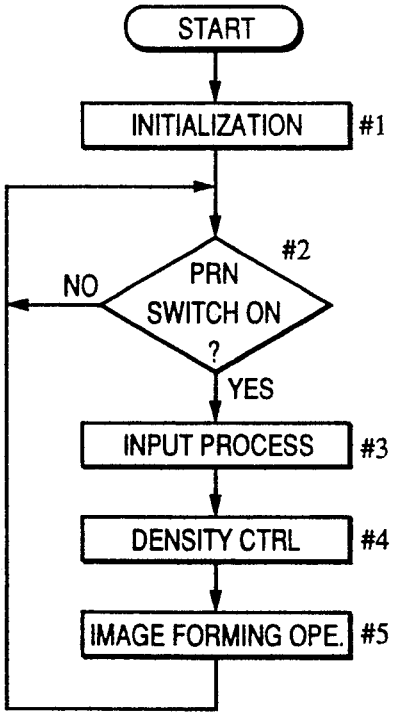
FIG. 7 is a flowchart showing a main flow of sequence of operation of the image forming apparatus.

The central procesing unit 21 employed in the image forming apparatus performs a control operation in a manner as shown in FIG. 7. Subsequent to the start, an initialization takes place at step #1, followed by a decision step at which a decision is made to determine if the PRN switch has been switched on. If the PRN switch has been switched on at step #2, an input processing takes place at step #3 for processing the various input signals including the input signals from various switches, keys and sensors and, subsequently at step #4, the density control takes place in a manner as will subsequently be described. Thereafter, the image forming operation takes place at step #5 with the program flow subsequently returning to step #2. The flow from step #2 to step #5 is repeated.

Figure 8:
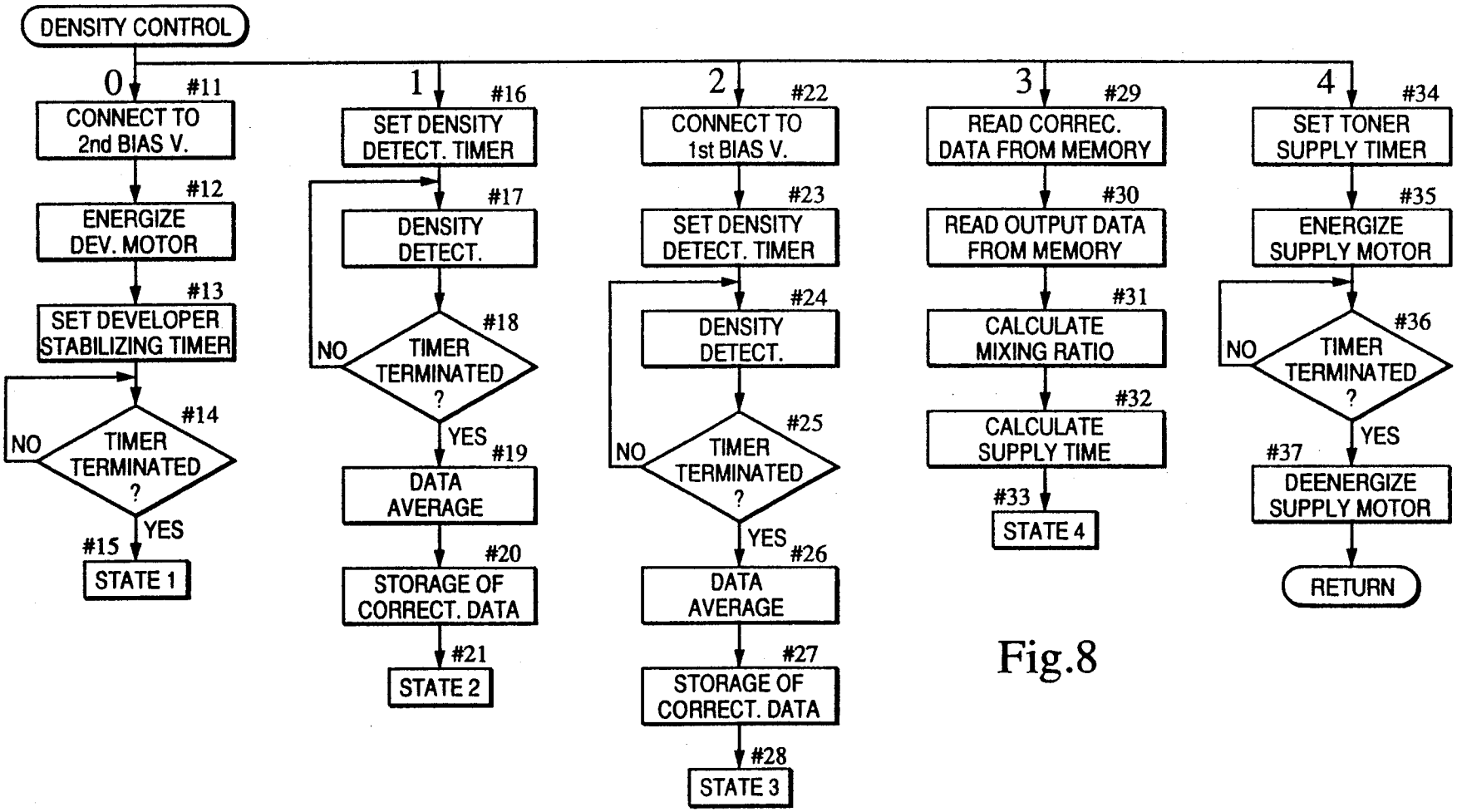
FIG. 8 is a flowchart showing a subroutine for the toner density control.

The toner density control which takes place at step #4 of the main flow of FIG. 7 is illustrated in FIG. 8 in detail. As shown in FIG. 8, at step #11 the selector switch 13 is set in position to connect the sensor windowpane 12 with the second bias voltage source 15 so than the bias voltage −200 volt which is 300 volt higher than the developing bias voltage of −500 volt can be applied to the sensor windowpane 12, followed by step #12 at which the developing motor is energized. Then at subsequent step #13, a developer stabilizing timer is set and, after the developer stabilizing timer has terminated at step #14, the sensor windowpane 12 is deposited with a sufficient quantity of toner and a state 1 is then established at step #15.

During the state 1, a density detecting timer is set at step #16 and the density detection takes place at subsequent step #17. This density detection continue until the density detecting timer is terminated at step #18. During the execution of the density detection step, the density detection is carried in a number of cycles and values detected one for each detection cycle are stored as detected data. Then, the detected data (reference outputs) Amax are averaged at step #19, followed by a storage thereof as a correction data at step #20 and, a state 2 is subsequently established at step #21.

During the state 2, the selector switch 13 is set in position to connect the sensor windowpane 12 to the first bias voltage source 14 to apply the bias voltage of −600 volt which is 100 volt lower than the developing bias voltage of −500 volt thereby to clean the toner off from the sensor windowpane 12 at step #22, followed by a setting of the density detecting timer at step #23. The toner density detection of the developing material on the developing sleeve 3 is carried out at step #24 until a result of decision at step #25 indicates that the density detecting timer has terminated. Thereafter, at step #26, detected data are averaged and, at step #27, the averaged detected data is stored as an output data, thereby establishing a state 3 at step #28.

During the state 3, the correction data and the output data are successively read out from a memory at steps #29 and #30 and, at step #31, using those data read out from the memory, the toner mixing ratio is calculated from the following predetermined table Table 1, followed by a calculation of the length of time during which toner is supplied at step #32 using the calculated toner mixing ratio with reference to the following table Table 2, with a state 4 subsequently established at step #33.

During the state 4, a toner supply timer is set based on the calculated length of time for the toner supply at step #34, followed by an energization of a toner supply motor. After the toner supply timer has terminated as determined at a decision step #36, the toner supply motor is deenergized at step #37, followed by a return of the program flow to the main flow.

TABLE 1

| Toner Mixing Ratio | Output Data (V) Correction Data (Ref. Outputs Amax V) | | | | | |
|---|---|---|---|---|---|---|
| | 5.0 | 4.9 | 4.8 | 4.7 | 4.8 | 4.5 |
| 7.9–8.0 | 3.1–3.2 | 3.2–3.3 | 3.3–3.4 | 3.4–3.5 | 3.5–3.6 | 3.6–3.7 |
| 7.8–7.9 | 3.0–3.1 | 3.1–3.2 | 3.2–3.3 | 3.3–3.4 | 3.4–3.5 | 3.5–3.6 |
| 7.7–7.8 | 2.9–3.0 | 3.0–3.1 | 3.1–3.2 | 3.2–3.3 | 3.3–3.4 | 3.4–3.5 |
| 7.6–7.7 | 2.8–2.9 | 2.9–3.0 | 3.0–3.1 | 3.1–3.2 | 3.2–3.3 | 3.3–3.4 |
| 7.5–7.6 | 2.7–2.8 | 2.8–2.9 | 2.9–3.0 | 3.0–3.1 | 3.1–3.2 | 3.2–3.3 |
| 7.4–7.5 | 2.6–2.7 | 2.7–2.8 | 2.8–2.9 | 2.9–3.0 | 3.0–3.1 | 3.1–3.2 |
| 7.3–7.4 | 2.5–2.6 | 2.6–2.7 | 2.7–2.8 | 2.8–2.9 | 2.9–3.0 | 3.0–3.1 |
| 7.2–7.3 | 2.4–2.5 | 2.5–2.6 | 2.6–2.7 | 2.7–2.8 | 2.8–2.9 | 2.9–3.0 |
| 7.1–7.2 | 2.3–2.4 | 2.4–2.5 | 2.5–2.6 | 2.6–2.7 | 2.7–2.8 | 2.8–2.9 |
| 7.0–7.1 | 2.2–2.3 | 2.3–2.4 | 2.4–2.5 | 2.5–2.6 | 2.6–2.7 | 2.7–2.8 |

TABLE 2

| Toner Mixin Ratio | Toner Supply Time |
|---|---|
| 8.0– | 0 sec |
| 7.9–8.0 | 200 |
| 7.8–7.9 | 400 |
| 7.7–7.8 | 600 |
| 7.6–7.7 | 800 |
| 7.5–7.6 | 1,000 |
| 7.4–7.5 | 1,200 |
| 7.3–7.4 | 1,400 |

TABLE 2-continued

| Toner Mix-in Ratio | Toner Supply Time |
|---|---|
| 7.2–7.3 | 1,600 |
| 7.1–7.2 | 1,800 |
| 7.0–7.1 | 2,000 |
| –7.0 | 2,200 |

Thus, according to the developing device embodying the present invention, the reference output inclusive of factors such as a change in characteristic of elements can be obtained by means of the sensor output provided while the toner is deposited on the sensor windowpane, and when the toner density is not detected, a depositing means is switched to establish a condition in which no toner is deposited on the sensor windowpane to provide the detected output. By correcting the detected outputs on the basis of the reference outputs, the toner density can be accurately detected in which any possible detection error which would otherwise result from the change in characteristic of the elements has been compensated for, and, since the developing device may remain to be of a standard structure, the developing device can be manufactured compact and at a reduced cost.

Although the present invention has been fully described in connection with the preferred embodiment thereof with reference to the accompanying drawings, it is to be noted that various changes and modifications are apparent to those skilled in the art. By way of example, it is to be noted that, in the flowchart of FIG. 8, each time the PRN switch is switched on, the states 0 to 4 are sequentially executed to detect the respective correction data. However, it may be modified such that the states 0 and 1 are executed when the machine is powered on or each time a predetermined number of copies have been made, to detect the respective correction data. Also, the detection of the correction data and the supply of the toner material may be carried out at different timings.

Although in the foregoing embodiment of the present invention the selector switch has been described as used to selectively switch the sensor windowpane to one of the first and second bias voltage sources, it may be modified that, while the bias voltage applied to the sensor windowpane remains constant, the developing bias voltage may be switched.

Accordingly, such changes and modifications are to be understood as included within the scope of the present invention as defined by the appended claims, unless they depart therefrom.

What is claimed is:

1. A developing device which comprises:

a radiating means for radiating rays of light onto a developing material;

a light sensor for receiving rays of light radiated from the radiating means and subsequently reflected from the developing material;

a toner density detecting means for detecting a toner density in the developing material based on an output generated from the light sensor;

a toner depositing means for forcibly depositing toner on a detection window of the light sensor; and a correcting means for correcting a value detected by the toner density detecting means based on an output generated from the light sensor during a condition in which the toner depositing means is operated.

2. The developing as claimed in claim 1, wherein said radiating means radiates infrared rays of light.

3. A developing device which comprises:

a radiating means for radiating rays of light onto a developing material on a developing sleeve;

a light sensor for receiving rays of light radiated from the radiating means and subsequently reflected from the developing material;

a toner depositing means for forcibly depositing toner on a detection window of the light sensor; and a toner density determining means for determining the toner density in the developing material by comparing the output generated from the light sensor when the toner depositing means is out of operation with the output generated from the light sensor when the toner depositing means is in operation.

4. The developing device as claimed in claim 3, wherein depositing of the toner on the detection window is carried out electrically.

5. The developing device as claimed in claim 4, wherein the toner depositing means selectively switches one of at least two voltages to be applied to the detection window.

6. The developing device as claimed in claim 3, wherein said radiating means radiates infrared rays of light.

7. A developing device which comprises:

a radiating means for radiating infrared rays of light onto a developing material on a developing sleeve;

a light sensor for receiving the infrared rays of light radiated from the radiating means and reflected from the developing material, said light sensor including a detection window made of a transparent electroconductive material;

a toner density detecting means for detecting a toner density in the developing material based on an output generated from the light sensor;

an electrically deposited toner control means for applying a voltage to the detection window of the light sensor for controlling a condition in which the toner is deposited on the detection window and a condition in which no toner is deposited on the detection window, said toner control means being operable to selectively apply to the detection window one of a first bias voltage higher than a developing bias voltage to be applied to the developing sleeve and a second bias voltage lower than the developing bias voltage;

a correcting means for correcting a value detected by the toner density detecting means based on an output generated from the light sensor during a condition in which the toner control means is operated; and a toner supply means for effecting a supply of the toner based on the value which has been detected and corrected.

8. A developing device which comprises:

a radiating means for radiating infrared rays of light onto a developing material on a developing sleeve;

a light sensor for receiving the infrared rays of light radiated from the radiating means and reflected from the developing material, said light sensor including a detection window made of a transparent electroconductive material;

a toner density detecting means for detecting a toner density in the developing material based on an output from the light sensor;

an electrically deposited toner control means for applying a voltage to the detection window of the light sensor for controlling a condition in which the toner is deposited on the detection window and a condition in which no toner is deposited on the detection window, said toner control means being operable to selectively apply one of at least two developing bias voltages to the detection window;

a correcting means for correcting a value detected by the toner density detecting means based on an output generated from the light sensor during a condition in which the toner control means is operated; and a toner supply means for effecting a supply of the toner based on the value which has been detected and corrected.

9. A developing device which comprises:

a radiating means for radiating rays of light onto a developing material;

a light sensor for receiving rays of light radiated from the radiating means and subsequently reflected from the developing material;

a toner density detecting means for detecting a toner density in the developing material based on an output generated from the light sensor;

a toner depositing means for electrically depositing toner on a detection window of the light sensor; and a correcting means for correcting a value detected by the toner density detecting means based on an output from the light sensor during a condition in which the toner depositing means is operated.

10. The developing device as claimed in claim 9, wherein the toner depositing means selectively switches one of at least two voltages to be applied to the detection window.

* * * * *

UNITED STATES PATENT AND TRADEMARK OFFICE

CERTIFICATE OF CORRECTION

PATENT NO. : 5,216,469

DATED : June 1, 1993

INVENTOR(S) : Takanobu Yamada

It is certified that error appears in the above-identified patent and that said Letters Patent is hereby corrected as shown below:

In col. 6, line 38, in the heading of TABLE 1, change "4.8" (second occurrence) to --4.6--.

In col. 6, line 60, in the heading of TABLE 2, change "Toner Mix-in Ratio" to --Toner Mixing Ratio--.

In col. 7, line 3, in the heading of TABLE 2-continued, change "Toner Mix-in Ratio" to --Toner Mixing Ratio--.

In col. 8, line 3, (claim 2, line 1), after "developing" insert --device--.

Signed and Sealed this

Fifteenth Day of February, 1994

Bruce Lehman

*Attest:*

BRUCE LEHMAN

*Attesting Officer*

*Commissioner of Patents and Trademarks*